United States Patent [19]

Johnson et al.

[11] Patent Number: 4,940,865

[45] Date of Patent: Jul. 10, 1990

[54] MICROWAVE HEATING APPARATUS AND METHOD

[75] Inventors: Andrew J. Johnson, Boulder; Robert D. Petersen, Thornton; Stephen D. Swanson, Brighton, all of Colo.

[73] Assignee: The United States of America as represented by the Department of Energy, Washington, D.C.

[21] Appl. No.: 261,865

[22] Filed: Oct. 25, 1988

[51] Int. Cl.[5] ..... H05B 6/80

[52] U.S. Cl. ..... 219/10.55 A; 219/10.55 D; 219/10.55 F

[58] Field of Search ..... 219/10.55 A, 10.55 F, 219/10.55 R, 10.55 D, 10.55 M; 252/626, 632; 34/1; 204/302

[56] References Cited

U.S. PATENT DOCUMENTS

| | | | |
|---|---|---|---|
| 2,500,752 | 3/1950 | Hanson et al. | 219/10.55 A |
| 2,586,754 | 2/1952 | Wild | 178/44 |
| 3,177,333 | 4/1965 | Lamb | 219/10.55 A |
| 3,336,142 | 8/1967 | Lawson | 219/10.55 A |
| 3,429,359 | 2/1969 | Hollingsworth | 164/37 |
| 3,436,506 | 4/1969 | Smith | 219/10.55 F |
| 3,770,870 | 11/1973 | Kervizic et al. | 13/31 |
| 3,777,106 | 12/1973 | Nuccel | 219/76 |
| 4,221,680 | 9/1980 | Hardwick et al. | 252/301.1 W |
| 4,256,944 | 3/1981 | Brandon | 219/10.55 F |
| 4,303,819 | 12/1981 | Kaufman, Jr. et al. | 219/10.55 R |
| 4,330,698 | 5/1982 | Sawada et al. | 219/10.55 A |
| 4,423,303 | 12/1983 | Hirose et al. | 219/121 P |
| 4,444,723 | 4/1984 | Matsumaru et al. | 422/159 |
| 4,476,098 | 10/1984 | Nakamori et al. | 422/140 |
| 4,490,287 | 12/1984 | Hardwick et al. | 252/629 |
| 4,565,670 | 1/1986 | Miyazaki et al. | 422/186.04 |
| 4,591,454 | 5/1986 | Ohtsuka et al. | 252/626 |
| 4,608,261 | 8/1986 | MacKenzie | 426/242 |
| 4,622,228 | 11/1986 | Ikeuchi et al. | 426/241 |
| 4,668,435 | 5/1987 | Grantham | 252/632 |
| 4,673,782 | 6/1987 | Koepke et al. | 219/10.55 M |

OTHER PUBLICATIONS

H. Oshima et al., "Continuous Denitration Test Equipment Using Microwave Heating", *The Toshiba Review*, 39(7), pp. 611-614, 1984. RPF-TRANS-462.

S. Priebe et al., "Application of Microwave Energy to Post-Calcination Treatment of High Level Nuclear Wastes", ICP-1183, Allied Chemical Corp. Idaho National Engineering Laboratory, Idaho Falls, Idaho, Feb., 1979.

J. D. Kaser, "Pilot Plant Vitrification of Simulated Alpha-Containing Alkaline Waste", BNWL-B-122, Batelle Pacific Northwest Laboratories, Richland, Washington, Aug., 1971.

R. D. Petersen et al., "Application of Microwave Energy for in Drum Solidification of Simulated Precipitation Sludge", RFP-4148, pp. 1-57, Jul. 19, 1987.

*Primary Examiner*—Philip H. Leung

*Attorney, Agent, or Firm*—Anne D. Daniel; James H. Chafin; William R. Moser

[57] ABSTRACT

An apparatus is provided for heating and melting materials using microwave energy, and for permitting them to solidify. The apparatus includes a microwave energy source, a resonant cavity having an opening in its floor, a microwave energy choke encompassing the opening in the floor of the cavity, a metal container to hold the materials to be heated and melted, a turntable, and a lift-table. During operation, the combined action of the turntable and the lift-table position the metal container so that the top of the container is level with the floor of the cavity, is in substantial registration with the floor opening, and is encompassed by the microwave energy choke; thus, during operation, the interior of the container defines part of the resonant cavity. Additionally, a screw feeder, extending into the cavity and sheltered from microwave energy by a conveyor choke, may convey the materials to be heated to the container. Also, preferably, the floor of the resonant cavity may include perforatins, so that the offgases and dust generated in the apparatus may be removed from the resonant cavity by pulling outside air between the container choke and the exterior wall of the container into the resonant cavity and out from the cavity through the perforations.

11 Claims, 4 Drawing Sheets

MICROWAVE HEATING APPARATUS AND METHOD

The United States Government has rights in this invention pursuant to Contract No. DE-ACO4-76DPO3533 between the United States Department of Energy and Rockwell International.

BACKGROUND OF THE INVENTION

The present invention relates to the field of microwave heating apparatus, and more particularly to microwave heating apparatus designed for heating materials in a container. More particularly, the invention relates to apparatus and a method for heating, melting, and solidifying waste materials, especially radioactive wastes. Most particularly, the present invention embodies a system for solidifying transuranic aqueous precipitation sludge by sintering or melting the waste to form a solid monolithic product using microwave technology.

In the art of microwave heating, materials to be heated are generally placed in containers that are, in turn, placed in a resonant cavity into which microwave energy is directed. The containers, themselves, are made from materials that are substantially transparent to microwave energy. A pertinent prior art patent is U.S. Pat. No. 4,330,698 of Sawada et al.

In the patent of Sawada et al., a process for treating a waste material is disclosed. A metal crucible is placed inside a detachable lower half of a resonant cavity. The detachable section is then lifted up to couple with the top section. A rotating shaft and table penetrate the lower section of the cavity to continuously turn the crucible. The material that is heated is moved continually through the microwave field. Consequently, large variations in reflected microwave power occur. A complicated continuously moving tuner is employed in order to minimize the reflected power due to the variations in the waste material surface.

In the Sawada et al. process, offgas and dust are removed from the system in the upper section of the cavity directly opposite of the microwave energy waveguide input. As a result, the residence time of the offgas and dust in the resonant cavity is relatively long thereby increasing the chance of ionization of the gas occurring.

The complexity of the resonant cavity of Sawada et al. makes it desirable to design a resonant cavity which allows easier access to the system than is obtained by Sawada. The complexity of the tuner required in the Sawada et al. system and process makes it desirable to provide a microwave heating system and process that does not require such a complex tuning system. The relatively long residence time of offgases in the Sawada et al. system makes it desirable to provide a microwave heating system that sweeps out offgases more rapidly.

Turning now to a specific waste disposal problem, one specific problem of utmost importance is the disposal of radioactive wastes. More specifically, process water in the nuclear industry may contain radioactive transuranic isotopes. A process for removing these wastes from the water and concentrating them involves a step employing aqueous hydroxide precipitation. As a result of this step, the transuranic isotopes are present as a solid hydroxide or oxide form in a water slurry. It would be desirable to trap and concentrate the waste hydroxides and oxides in the slurry to further reduce the volume they occupy. Furthermore, it would be desirable to transform the waste products from an aqueous slurry into a substantially dry product.

Microwave technology has been used in the food and chemical industries since early 1970, with the majority of the work concentrated in the area of drying and the vulcanization of rubber. High-temperature technology has been developed by the Japanese for converting plutonium nitrate, recovered from spent fuel reprocessing, to plutonium oxide for nuclear fuel production, as disclosed in "Continuous Denitration Test Equipment Using Microwave Heating", by Hirofumi Wshima, Nobuo Tsuji, and Hajime Sato, RFP-TRANS-462, translated from *The Toshiba Review*, 39(7), 611–614, 1984. Laboratory scale vitrification of calcined high-level nuclear wastes using microwave energy was done by the Idaho National Engineering Laboratory, as disclosed in *Application of Microwave Energy to Post-Calcination Treatment of High Level Nuclear Wastes*, ICP-1183, Allied Chemical Corporation, Idaho National Engineering Laboratory, Idaho Falls, Idaho, Feb., 1979, In the Idaho experiment, high-level wastes were mixed with a composite of fluxing agents in ceramic crucibles and placed in a microwave cavity. The resulting glass was allowed to solidify.

Nevertheless, none of the prior art accomplishes the objectives and achieves the benefits of the invention described below.

SUMMARY OF THE INVENTION

Accordingly, it is an object of the present invention to provide a simple resonant cavity suitable for heating waste materials and adapted to allow for turning the container in which the materials reside, for easy access to the system, and for sweeping offgases from the resonant cavity.

Another object of the invention is to provide a microwave heating system that does not require complex tuning equipment.

Another object is to provide a microwave heating system that provides a relatively short residence time of offgases and dust in the resonant cavity.

Still another object of the invention is to provide a process for solidifying waste products, including radioactive wastes.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention, an improved apparatus and method is provided for heating materials using microwave energy. The apparatus comprises: a microwave energy source; a resonant cavity for receiving microwave energy from the energy source, wherein the resonant cavity has a ceiling, walls, and a floor having an opening; and a microwave energy reflective container (e.g. made of metal) for holding the materials to be heated, the top of the container being level with the floor and in substantial registration with the floor opening, whereby the interior of the container defines part of the resonant cavity.

The apparatus also includes a microwave energy choke which encompasses the floor opening and is located outside of the cavity. The top of the microwave energy reflective container is not only level with the floor and in substantial registration with the floor opening, but also the top of the container is encompassed by the microwave energy choke.

In accordance with another aspect of the invention, a method is provided for microwave solidification of the waste products. The method comprises the following steps: solid waste products are exposed to microwave energy that causes the waste products to be resonated and heated; heating is maintained with microwave energy to raise components of the waste products to their melting points; and the melt is permitted to cool and solidify. Initially, the waste products may be filtered through filter media, e.g. diatomaceous earth, to obtain a sludge, and the sludge may be dried prior to the microwave solidification.

Waste forms which can be solidified according to the method of the invention include products of aqueous hydroxide precipitation processes and other processes employed to remove radioactive transuranic isotopes from waste water, and products of waste materials containing metal oxides and silicates, among other mixtures. Also, the process has potential for use in hazardous waste destruction and fixation and high level waste vitrification, as well as solidification of commercial nuclear power plant wastes or other commercial wastes such as sewage sludge.

Still other objects of the present invention will become readily apparent to those skilled in this art from the following description, wherein there is shown and described a preferred embodiment of this invention. Simply by way of illustration the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings:

FIGS. 1–4 are front, side, and top views, respectively, of the same microwave heating apparatus, with the drum in lowered or resting position.

DETAILED DESCRIPTION

Figure 1:
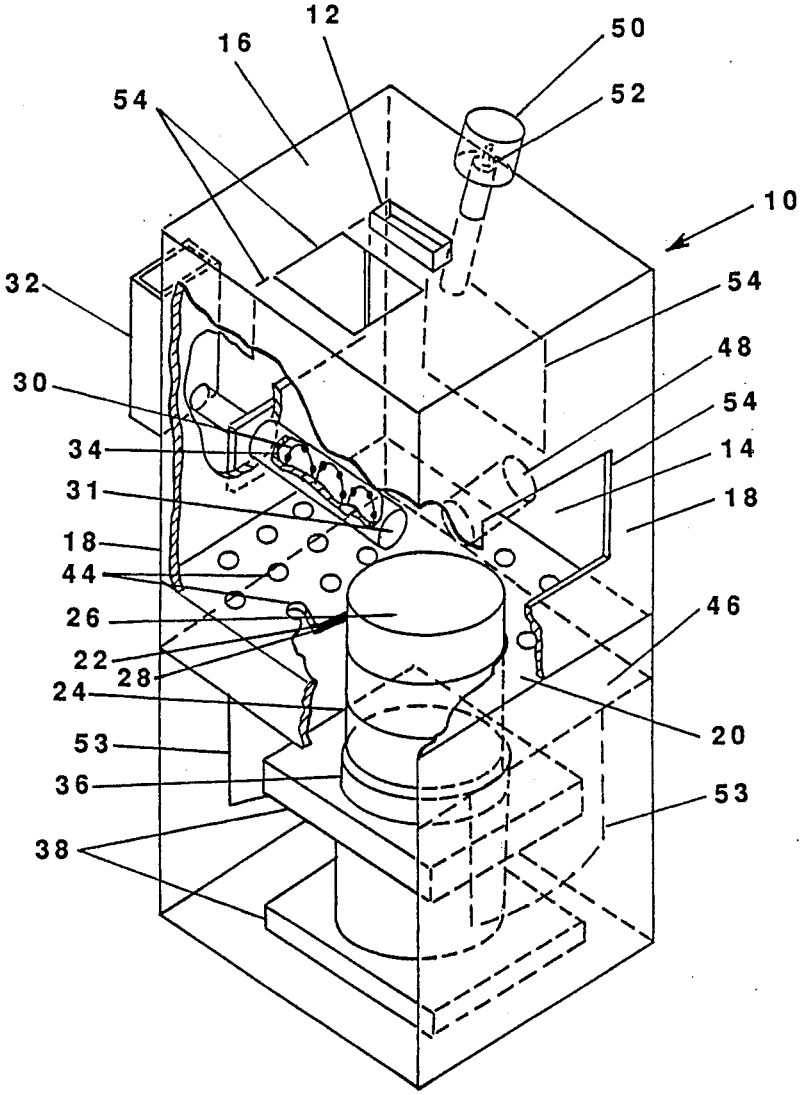
FIG. 1 is a perspective view of a microwave heating apparatus which includes a drum, a turntable, a lift table, means to ventilate the resonant cavity, and a screw feeder to supply materials to be solidified, with the drum in lifted or operating position.
Figure 2:
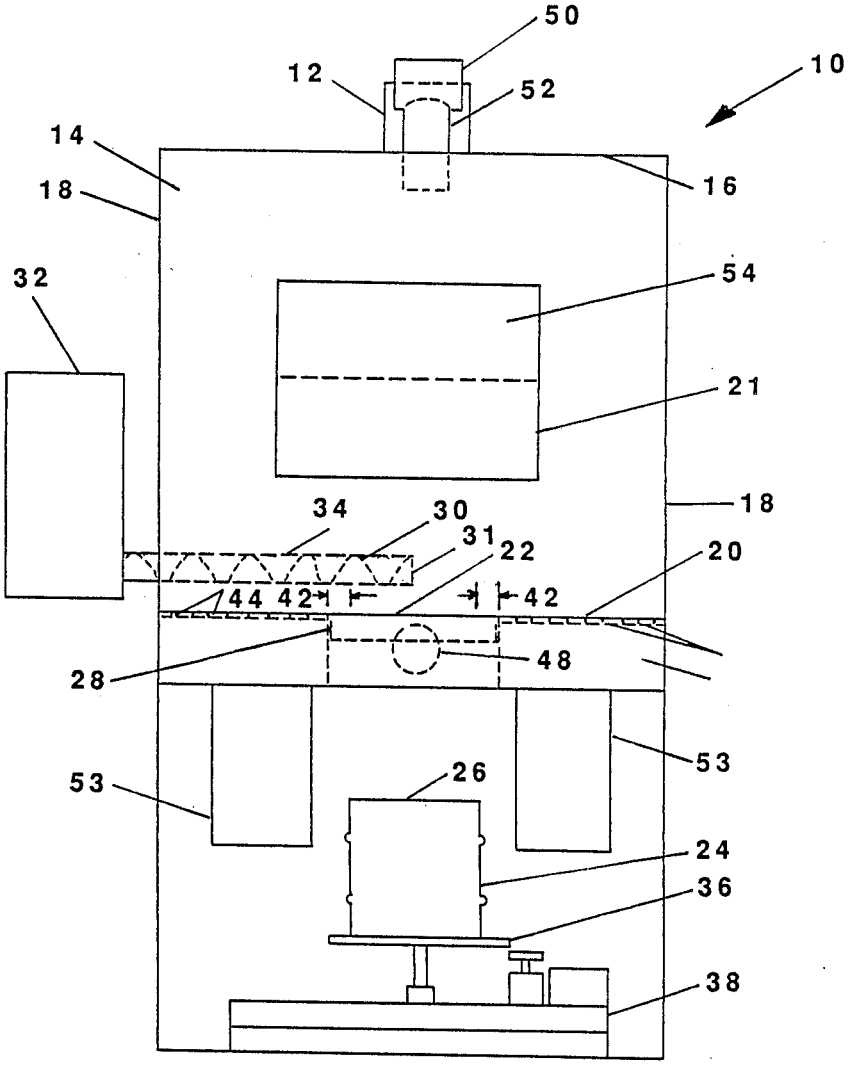
Figure 3:
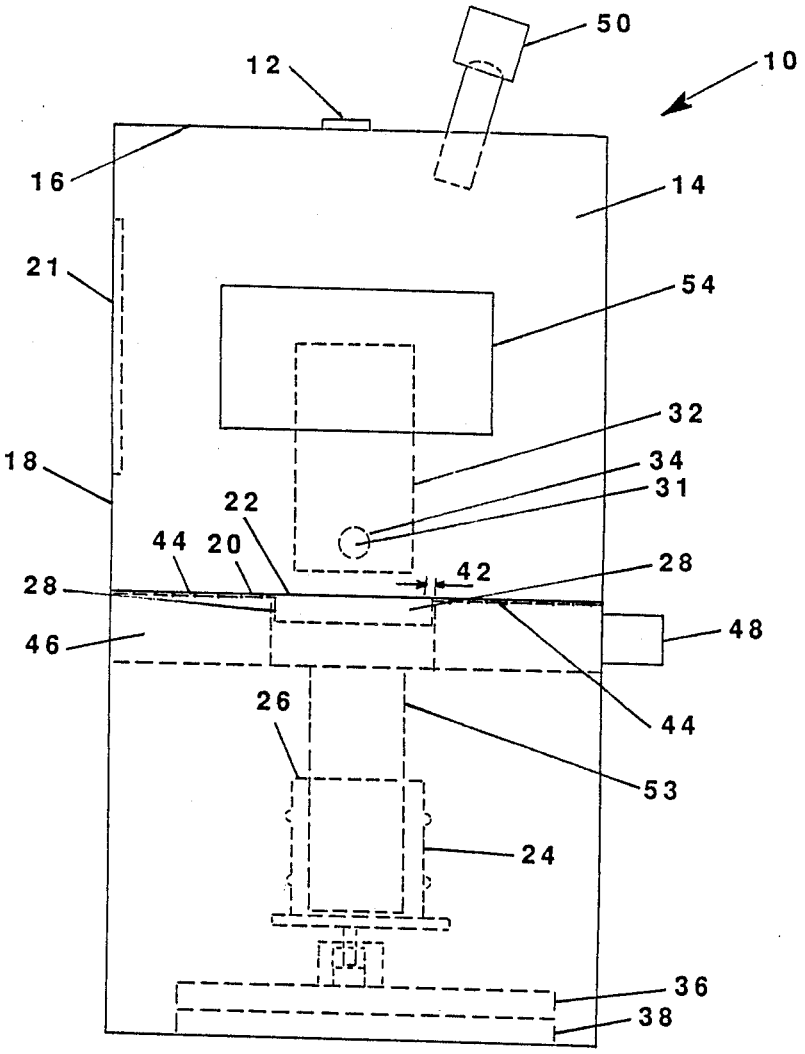
Figure 4:
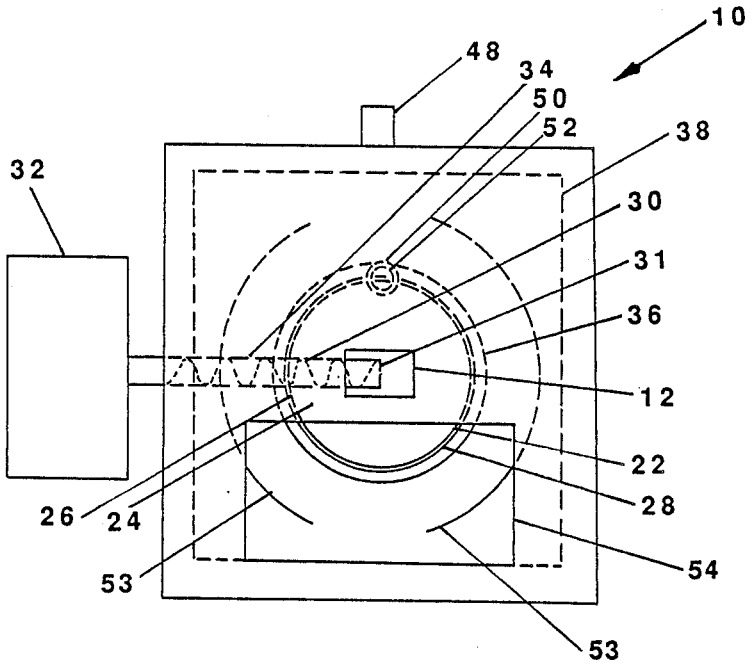

With reference to FIGS. 1–4, apparatus 10 for heating materials using microwave energy includes a microwave energy input 12 and a resonant cavity 14 enclosed by ceiling 16, walls 18, and a floor 20. A hinged door 21, shown only in FIG. 2, may also be provided. Windows 54 may also be provided in the sides, top, and back of resonant cavity 14, to permit an operator to view inside resonant cavity 14 during operations. Floor 20 includes an opening 22. The walls, ceiling, and door may be fabricated from 304 stainless steel. The inside dimensions of resonant cavity 14 may be 50 inches×50 inches×39 inches.

A metal drum 24, whose inner surface reflects microwave energy, is used to contain the materials (not shown) to be heated. When the apparatus is in operation, top 26 of drum 24 is level with floor 20 and is in substantial registration with floor opening 22, whereby the interior of drum 24 defines a part of resonant cavity 14, allowing the materials in drum 24 to be exposed to microwave energy. More specifically, drum 24 provides a floor portion and bottom wall portions of resonant cavity 14 which extends into the interior of drum 24. To minimize arcing between drum 24 and walls 18 and floor 20 of resonant cavity 14, walls 18 may be one wavelength from top 26 of drum 24.

A microwave energy choke 28 encompasses floor opening 22 and is located outside of resonant cavity 14. Top 26 of drum 24 is also encompassed by microwave energy choke 28. Choke 28 is 20 inches in diameter and is a standard finger type choke.

A material conveyor such as screw feeder 30 extends into resonant cavity 14 from outside cavity 14. A hopper 32 may be placed at the input end of screw feeder 30 for feeding materials into resonant cavity 14. Screw feeder 30 and the contents therein are sheltered from microwave energy by a cylindrical conveyor choke 34. The output end 31 of screw feeder 30 is positioned with respect to drum 24 so that the material to be heated falls from output end 31 directly into drum 24 positioned directly below.

The apparatus of the invention preferably also includes a turntable 36 and a lift table 38. Drum 24, lift table 38, and turntable 36 are all located outside the resonant cavity 14. Drum 24 holding the materials to be heated rests upon turntable 36. Lift table 38 is provided to raise and lower drum 24 and turntable 36 during loading and unloading operations. Turntable 36 is placed on lift table 38, and drum 24 on turntable 36 is lifted by lift table 38 to floor opening 22. Turntable 36 rotates drum 24 as desired, either continuously or intermittently. A door (not shown) may be provided outside of and below resonant cavity 14 for access to drum 24, lift table 38, and turntable 36.

Preferably, turntable 36 may be operated intermittently in a time delayed manner. The intermittent, time delayed movement of the turntable serves three purposes: first, the reflected power becomes controllable allowing time for tuner adjustments, second, it turns the container for uniform addition of material and third, the material is moved through the energy field so heating is also uniform.

More specifically, turntable 36 may be operated intermittently, for example, on for 0.25 seconds and off for 32 seconds, and the material in drum 24 moves through the microwave field for uniform heating.

Alternatively, as mentioned above, the turntable 36 may be operated continuously. However, when the material is not continually moved through the microwave field, large variations in reflected power do not occur. Therefore, a complicated tuning system is not required. Tuning the system requires using any one of a number of commercially available impedance matching devices. Once the reflected power is minimized, on a particular run, the tuner is not touched again.

A close fit between top 26 of drum 24 and microwave energy choke 28 is not necessary. More specifically, a clearance 42 may be present between floor opening 22 and top 26 of drum 24. The clearance 42 is relatively small and substantially prevents microwave energy from leaking out of resonant cavity 14.

Floor 20 of resonant cavity 14 has a plurality of small perforations 44. Perforations 44 are small enough to prevent microwave energy from leaking from resonant cavity 14, while still permitting venting of offgases and dust from resonant cavity 14.

More specifically, vent space 46, located outside the resonant cavity 14, extends below floor 20. A vent outlet 48 is employed to create a negative pressure inside resonant cavity 14. Outside air will then enter resonant cavity 14 through perforations 44 (or between choke 28 and the exterior wall of drum 24), be drawn through resonant cavity 14, and exit from cavity 14 through perforations 44 closer to vent outlet 48. In this way, outside air is used to sweep off-gases and dust generated in the apparatus from resonant cavity 14 and, thereby decrease the likelihood of the formation of ionizing gases.

Sensor means 50 are also provided for measuring the temperature of the materials being heated in resonant cavity 14. A microwave energy choke 52 is provided to shelter sensor means 50 and is positioned so as to obtain accurate measurements of the contents of drum 24. In this respect, an infrared-based sensor means 50 would be aimed directly into drum 24. Sensor 50 is preferably placed in an off-center position in ceiling 16. Also, "clam shell" insulators 53, having Type "K" thermocouples (not shown), may be provided outside resonant cavity 14, and are placed in contact with the drum wall, outside the cavity, to measure and control drum temperature.

Conveyor choke 34 and sensor choke 52 may be two inch diameter, 6 inch long metal pipes.

Apparatus 10 of the invention can be employed in a wide variety of heating and drying operations. In accordance with the method of the invention, materials deposited in container 14 of apparatus 10 are exposed to microwave energy, are heated to their melting points, and the melted mixture is permitted to cool and solidify. The materials that are heated may be a wide variety of waste materials, especially radioactive wastes. According to the method of this invention, higher power levels obtained by this device result in higher flow rates within the system, as components in the waste are resonated to their melting points by the microwave energy.

More specifically, microwave solidification of waste products occurs by feeding waste, usually in the form of dried sludge, into drum 24, by means of screwfeeder 30. Generally, this sludge has been dried to 2–5 weight % moisture, i.e. a dry material, using a microwave dryer.

Typically, an initial charge is added to drum 24 to initiate a melt, then, after the initial charge substantially melts, screwfed addition is started. Screwfeeder 30 and storage hopper 32 meter the sludge into drum 24.

The waste form in drum 24 is exposed to microwave energy emitted from microwave input 12. Although a wide range of operating parameters for the apparatus may be selected depending upon specific materials being treated, for treating transuranic hydroxide and oxide wastes, the microwave energy source may operate in a range of 0–100 kilowatts. In any case, microwave energy is maintained at a level that will raise the waste products to their melting points.

One type of waste that may be treated according to the process of the invention is waste containing metal oxides and silicates. Melt of this type of waste is accomplished, without additives, by causing the metal oxides contained in the waste to resonate, using either 2450 MHZ or 915 MHZ microwave energy.

Also, another waste form that may be processed through apparatus 10 is a product of an aqueous hydroxide precipitation process designed to remove radioactive transuranic isotopes from process waste water. The final processing step for this waste form is a finishing filter that uses a diatomaceous earth filter media. Diatomaceous earth is comprised of the remains of unicellular algae having siliceous cell walls, containing up to 88% silicon dioxide. Due to the high silicate content of the waste, the high temperature process of the invention can be used to melt the silicates in the waste, forming a vitreous monolith.

Alternatively, waste products of other types may be processed in apparatus 10, after a flux material is added to the waste form to obtain a mixture which will respond to the microwave energy.

Sludge is rotated in resonant cavity 14 by turntable 36, as discussed above, thus allowing the entire mass to be evenly exposed to the microwave field. A melt is obtained from the waste by the vigorous vibrating of the various receptive, "lossy" compounds contained in the particular waste. After final sludge addition, the cast of the waste materials containing the metal silicates is left in cavity 14 until offgassing ceases. The residence time of the gas in cavity 14 is very low, lessening the chance for ionization of the gas by the microwave field.

All further processing of the composite material is done "in situ", i.e. in the drum without requiring separate containers. After a composite melt is obtained, drum 24 containing the melt is removed from the microwave energy, and the melt is allowed to cool and solidify.

An embodiment of an apparatus made in accordance with the invention has been tested in a process for treating precipitation sludges to reduce their volume. Microwave energy of either 2450 MHz or 915 MHz has been used successfully with such sludges.

More specifically, the application of microwave energy for in-container solidification of simulated transuranic (TRU) contaminated aqueous precipitation sludges was studied. Preliminary results indicate that volume reductions of 80% are achievable by the continuous feeding of dried sludge into a waste container while applying microwave energy. An evaluation was completed showing that volume and weight reductions of up to 87% are achievable over an immobilization process currently in use on wet sludge.

These aqueous wastes from the plutonium recovery areas at the Rocky Flats Plant (RFP) are treated in a hydroxide precipitation process to remove heavy metallic elements. The resultant slurry is passed through a rotary drum vacuum filter precoated with diatomaceous earth filter media to remove the solids from the waste stream.

There are three primary mechanisms involved in heating with microwave energy. Type I is characterized the vigorous vibration of a dipole molecule due to the oscillation of the electromagnetic field. The vibration causes frictional heat to build up between the molecules which elevates the temperature of the material. The simulated sludge used in the tests contain metal oxides ($MgO$, $Al_2O_3$, $CaO$ and $SiO_2$) which are normally electrically neutral; however, when placed in an electromagnetic field they become dipolar.

Type II heating involves substances that are magnetic in nature and couple with the magnetic component of the microwave field. The oscillation of the magnetic component of the field results in hysteresis loss within the material which generates heat. Ferrites are materials that exhibit this property when placed in the microwave field.

Type III heating takes place when an electrically conductive material, such as a carbon black, is a component of the material being heated. A current is generated throughout the material by the electric component of the microwave field. The material is heated by the current flow through the material resistance, as disclosed more fully in *Pilot Plant Vitrification of Simulated Alpha-Containing Alkaline Waste*, BNWL-B-A22, Battelle Pacific Northwest Laboratories, Richland, Wash., Aug., 1971.

The sludge used in the bench scale tests was produced to simulate the transuranic (TRU) waste generated in the waste processing facilities at RFP. Two examples of TRU sludge were taken involving two separate waste streams taken from an old waste processing facility. Analysis of the precipitation sludges produced at RFP have shown that the waste may obtain up to 75 weight % diatomaceous earth.

The composition for the sludge used in the microwave solidification study is given in Table 1. Diatomite ® used in current production process and for microwave feed, contains high amounts of metal oxides.

TABLE 1

COMPOSITION OF SIMULATED SLUDGE USED IN MICROWAVE STUDIES

| | wt % |
|---|---|
| $Al_2O_3$ | 6.5 |
| NaOH | 2.5 |
| $Na_3PO_4$ | 0.4 |
| MgO | 5.5 |
| $K_2CO_3$ | 0.9 |
| $Fe_2O_3$ | 3.5 |
| $NaNO_3$ | 0.9 |
| Diatomite ® | 74.3 |

The sludge was produced by adding the compounds to 50 gallons of water and then passing the mixture through a vacuum drum filter, precoated with Diatomite ®. The resulting sludge had a moisture content of approximately 52 wt %.

Melting tests were performed, using bench scale microwave equipment on simulated sludge, to determine the feasibility of adding microwave energy to simulated waste in a metal waste container and solidifying the waste to form either a melt or a sintered waste form, thus reducing the volume of the sludge and producing a certifiable waste form. Collection of data important for further development of a microwave system included: (1) simulated sludge feedrate, (2) rate of addition to the waste container, (3) volume and weight reductions that could be realized and (4) physical properties of the final waste form.

Results of the melting tests indicate that weight and volume reductions, over presently produced wastes, are achievable and the waste form produced through the process will meet present waste criteria. The equipment used in the bench scale tests included; (1) a standard microwave generator, (2) an 18"×18"×30" aluminum cavity with a turntable, (3) a three stub tuner, (4) waveguides, (5) reflected power meter, (6) infrared (IR) thermometer and (7) a screw feeder. Chokes were added to the cavity for mounting the IR thermometer and screw feeder. The chokes consisted of 1.25" ID aluminum tube, 8" long, continuously welded to the cavity. The turntable was modified from continuous to intermittent operation by controlling the on/off switch with a timer. The table turned approximately one-quarter turn per pulse.

In the batch fed method, an initial charge of 2 kg of dry sludge was added to an 8 liter stainless steel container. The container exterior was insulated using ½ inch thick Fiberfrax insulation. The container was centered on the turntable and the input set at 4 kW. Initial melting occurred within 5–10 minutes; the charge was allowed to stand in the microwave field for 45–60 minutes or until all bubbling action ceased. Subsequent 2.5 kg additions were made to the container and allowed to heat for the same amount of time. Temperatures of the melt ranged from 1000° C.—1300° C.

Final densities for the batch fed samples ranged from 1.0 g/cc to 1.44 g/cc, with an average density of 1.21 g/cc. The increase in density from approximately 0.40 g/cc for the bulk powder is a result of the removal of entrained air and destruction of the cell structure of the diatomite by fusing the discrete particles into a single mass. The increase in density translates into an average 74.8% volume reduction. Weight reductions for the test runs averaged 16.6%. The majority of the loss in weight can be attributed to the evaporation of water from, and decomposition of some of the components in, the sample. The feedrate used to estimate the average flowrate for the batch fed trials was 1.0 kg/kW-hr.

In general, all of the sludge samples behaved similarly when placed in the microwave field. The average melting times were controlled by the operator by visual inspection of the melt, but the melting temperatures remained constant for each trial.

Two methods were used to increase the density of the final cast. The first was the addition of fluxes to the sludge to decrease the molten viscosity, and the second was to continuously feed the sludge into the container. Fourteen trials were made using various fluxing agents, 11 batch fed and 3 continuously fed.

The average volume reduction for the fluxed samples, excluding the anhydrous and hydrated borax, was 52.1%, as compared to 79.0% for the borax. The continuously fed borax samples were higher in density than the batch fed samples. The average density and resulting volume reduction for the continuously fed samples were 2.25 g/cc and 82.9%, respectively, excluding the 30 wt % diatomite sample.

In general, the continuous feeding of material into the waste container resulted in higher densities and greater volume reductions than the batch fed method. Nine tests were performed continuously feeding sludge through a screwfeeder into an 8 liter container. An initial 2.0 kg charge was added to the container to initiate a melt. After the initial charge melted and the infrared thermometer was consistently above 1000° C., screwfed addition was started. The screwfeeder hopper was filled with 2.0 kg of sludge at approximately 60 minute intervals and the sludge was metered in over this period. After the final addition of sludge, the cast was left in the microwave field for approximately 30 minutes or until all bubbling action ceased.

Two trials were run using sludge that contained less diatomite to determine the effect on the volume reduction and physical characteristics of the final cast. One sample contained 65 wt % diatomite and another contained 30 wt % diatomite. The density and volume reduction of the 60 wt % sample was the same as the other samples; however, in comparison, the 30 wt % sample exhibited a relatively low density, and volume reduction, 1.3 g/cc and 27%, respectively.

Two trials were done using carbon steel containers to determine the effect of heating the material over an extended period of time. The containers were constructed from 16 gauge carbon steel to simulate the metal drums that are being considered for an upscaled system. Approximately 10 % of the metal thickness was oxidized on the section of the container exposed to the melt.

A general conclusion can be drawn from the bench scale tests of the microwave system using simulated TRU waste. Waste sludges produced at the Rocky Flats Plant with a diatomaceous earth content of 60 to 75 wt %, will readily melt using microwave energy. Volume reductions of up to 83% over the dry sludge have been achieved. The process produces a monolith that meets radioactive waste storage criteria, namely the absence of free liquids and excessive particulate. The overall volume and weight reductions over the present immobilization system of wet sludge and absorbent may be up to 87%, resulting in substantial annual operating cost savings.

The apparatus and method of the invention have distinct advantages over the previously used systems for waste solidification. Addition of microwave energy for solidification includes distinct advantages over other processes, these include; (1) direct addition of the energy to the media, (2) in-container processing, (3) remote operation while isolating major pieces of equipment from hostile environments and (4) containment of high temperatures to the media while surrounding equipment exhibits relatively low temperature. Also, the waste container can be handled outside the microwave field and the process can be remote from the energy source.

The foregoing description of the invention has been presented for purposes of illustration and description. It is not intended to be exhaustive or to limit the invention to the precise forms disclosed. Obvious modifications or variations are possible in light of the above teachings. The embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A microwave apparatus for heating materials, said apparatus comprising:

a microwave energy input for delivering microwave energy, a resonant cavity for receiving microwave energy through said input, said cavity including a ceiling, walls, and a floor, said floor having a floor opening, a microwave energy choke encompassing said floor opening of said resonant cavity, a microwave energy reflective container for holding said materials to be heated, said container having a top portion at least as large as said floor opening of said resonant cavity, a floor portion, wall portions, and an interior, and capable of being positioned to bring said top portion level with said floor of said resonant cavity, and in substantial registration with said floor opening of said resonant cavity, means for turning said container during exposure of said materials in said container to microwave energy, located outside of said cavity, and means for lifting said container, located outside of said cavity, whereby said means for turning is placed on said means for lifting, and said container is placed on said means for turning and lifted by said means for lifting to bring said top portion of said container level with said floor of said resonant cavity and in substantial registration with said floor opening of said resonant cavity, said choke encompassing said top portion of said container, and whereby said floor portion and said wall portions of said container define a bottom floor portion and bottom wall portions of said resonant cavity and said interior of said container defines part of said resonant cavity, and whereby said materials in said container are exposed to microwave energy, are melted, and are permitted to cool and solidify.

2. The apparatus described in claim 1, wherein said microwave energy input is less than 100 kilowatts.

3. The apparatus described in claim 1, wherein said floor of said resonant cavity includes a plurality of perforations.

4. The apparatus described in claim 3, further comprising means for removing offgas and dust from said resonant cavity by pulling outside air between said choke and the exterior wall of said container into said resonant cavity through said perforations.

5. The apparatus described in claim 1, further comprising:

means, extending into said resonant cavity, for conveying said materials to be heated to said container, said conveying means having a conveyor choke for sheltering said conveying means from microwave energy.

6. The apparatus described in claim 5 wherein said conveying means includes a screw feeder.

7. The apparatus described in claim 1, further comprising:

means for measuring the temperature of the materials in said container.

8. The apparatus described in claim 7, further comprising:

choke means for sheltering said temperature measuring means from microwave energy.

9. The apparatus described in claim 1 wherein said turning means may be operated continuously.

10. The apparatus described in claim 1 wherein said turning means may be operated intermittently in a time delayed manner.

11. The apparatus described in claim 1, further comprising:

a door in at least one of said walls of said cavity, and a window in at least one of said walls of said cavity for viewing the interior of said cavity.

* * * * *